US006691823B2

(12) United States Patent
Lee et al.

(10) Patent No.: US 6,691,823 B2
(45) Date of Patent: Feb. 17, 2004

(54) SUCTION MUFFLER IN RECIPROCATING COMPRESSOR

(75) Inventors: In Won Lee, Seoul (KR); Kwang Hyup An, Seoul (KR); Jeong Ho Lee, Goyang-si (KR); In Seop Lee, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/191,074

(22) Filed: Jul. 10, 2002

(65) Prior Publication Data

US 2003/0127282 A1 Jul. 10, 2003

(30) Foreign Application Priority Data

Jan. 10, 2002 (KR) ..... 2002-1456

(51) Int. Cl.[7] ..... G10K 11/00

(52) U.S. Cl. ..... 181/403; 181/221; 181/229; 181/233; 181/237; 181/262

(58) Field of Search ..... 181/403, 262, 181/263, 237, 233, 221, 228, 229; 417/312, 902; 137/15.26, 15.21, 15.17

(56) References Cited

U.S. PATENT DOCUMENTS 5,966,942 A * 10/1999 Mitchell ..... 62/6
6,325,600 B1 * 12/2001 Lilie et al. ..... 417/312
6,390,788 B1 * 5/2002 Tack ..... 417/312
6,488,482 B1 * 12/2002 Yannascoli et al. ..... 417/312

FOREIGN PATENT DOCUMENTS

JP 06074051 A * 3/1994 ..... F02B/27/06

* cited by examiner

*Primary Examiner*—Robert Nappi
*Assistant Examiner*—Renata McCloud
(74) *Attorney, Agent, or Firm*—Birch, Stewart, Kolasch & Birch, LLP

(57) ABSTRACT

A suction muffler in a reciprocating compressor is installed over a suction valve to attenuate complex sound pressure (noise) such as vibrational noise, valve sonance, flowing noise and pulsative noise produced from the suction valve when low temperature, low pressure refrigerant gas ejected from an evaporator is sucked into a cylinder via the suction valve and a suction portion of the cylinder. A Tesla valve having two distribution paths is mounted in the suction muffler to attenuate the complex sound pressure (noise) while preventing the reflow of the refrigerant gas into the suction muffler from the suction valve. As a result, the Tesla valve also enhances the cooling ability of the compressor and the attenuation effect.

28 Claims, 9 Drawing Sheets

SUCTION MUFFLER IN RECIPROCATING COMPRESSOR

BACKGROUND OF THE INVENTION

1. Field of the Invention

The present invention relates to a suction muffler in a hermetic reciprocating compressor, in particular, which provides a valve construction having distribution paths inside the suction muffler in order to facilitate the flow of refrigerant gas as well as attenuate various noises created from suction valve.

2. Description of the Related Art

As well known to the skilled in the art, compressors for converting mechanical energy into compressed energy of compressive fluid are divided into a reciprocating compressor, a scroll-type compressor, a centrifugal (turbo) compressor, a vane-type (rotary) compressor and the like.

In the reciprocating compressor (so-called hermetic reciprocating compressor) of the above compressors, a driving motor drives a crank shaft with rotating force, which is converted into linear reciprocating motion by a connecting rod connected to the crank shaft so that a piston sucks in refrigerant gas with low temperature and pressure to discharge the same after converting into the refrigerant gas with high temperature and pressure while linearly reciprocating within a cylinder.

FIG. 1 is the schematic construction of a reciprocating compressor.

Referring to FIG. 1, the reciprocating compressor is constituted of a hermetic vessel 110 defining a housing, a frame 120 installed inside the hermetic vessel 110, a driving motor M installed under the frame 120 and having a stator 130 and a rotor 140, a crank shaft 150 coupled to the inside diameter of the rotor 140 of the driving motor and having an eccentric section 151 at one end, a connecting rod 171 connected to the eccentric section 151 of the crank shaft 150 and the lower end of the piston 170 for converting the rotating force of the crank shaft 150 into linear reciprocating motion, a cylinder 160 coupled to the upper part of the frame 120 and a piston 170 connected to the connecting rod 171 coupled to the eccentric section 151 of the crank shaft 150 for linearly reciprocating inside the cylinder 160.

The cylinder 160 is provided with suction and discharge valves 180 and 190 for sucking in and exhausting refrigerant gas, in which the suction and discharge valves 180 and 190 are respectively provided with a suction muffler 230 and a discharge plenum 240 as shown in FIG. 2.

Referring to FIG. 2, in the discharge plenum 240, the refrigerant gas compressed in high temperature and pressure through linear movement of the piston 170 is ejected via a outlet 162 and the discharge valve 190 of the cylinder 160, and the refrigerant gas in high temperature and pressure ejected through the outlet 162 and the outlet 190 flows to the discharge pipe 241 which is installed in one side of the cylinder.

Further, the suction muffler 230 is provided with a refrigerant suction portion 231 at one side and a suction pipe 220 linearly extended from the suction portion 231, in which the refrigerant gas changed into low temperature and pressure by an evaporator (not shown) is introduced to the refrigerant suction portion 231, and sucked into the suction portion 161 and the suction valve 180 of the cylinder 160.

The suction tube 220 of the suction muffler 230 is spaced from the suction tube 210 penetrating the hermetic vessel 110 with a predetermined interval so that the refrigerant gas in low temperature and pressure flowing from the evaporator is introduced into a compressor. Also shown is a refrigerant outlet 232.

The hermetic reciprocating compressor constructed as above is operated as follows.

Referring to FIGS. 1 and 2, when the hermetic reciprocating compressor is energized, a current is induced between the stator 130 and the rotor 140 which are components of the driving motor M so as to rotate the rotator 140. Rotation of the rotor 140 makes the crank shaft 150 inserted into the rotor 140 rotate in the same direction as the rotor 140.

Rotation of the crank shaft 150 causes the connecting rod 171 connecting between the eccentric section 151 of the crank shaft 150 and the piston 170 to linearly reciprocate as well as the piston 170 to linearly reciprocate within the cylinder 160 also.

When the piston 170 linearly reciprocates like this, the refrigerant gas in low temperature and pressure ejected from the evaporator is introduced into the suction muffler 230 through the suction tube 220 of the suction muffler 230 and the refrigerant suction portion 231.

The refrigerant gas in low temperature and pressure introduced into the suction muffler 230 is introduced into the cylinder through the suction valve 180 and the suction portion 161 mounted in the exit side, and the refrigerant gas introduced into the cylinder 160 is compressed into a high temperature and pressure by the piston 170 linearly reciprocating within the cylinder 160.

The refrigerant gas compressed into the high temperature and pressure by the piston is ejected to the discharge plenum 240 through the outlet 162 and the discharge valve 190 of the cylinder, and the refrigerant gas discharged to the discharge plenum 240 is flown into the discharge pipe 241 installed under the discharge plenum 240 so as to circulate in a cooling cycle.

However, referring to the flow of the refrigerant gas in the suction muffler 230 of the related art as shown in FIG. 2, the refrigerant gas in low temperature and pressure flows backward into the suction muffler 230 from the suction valve 180 while it flows along a suction path of the refrigerant gas leading to the suction portion 161 of the cylinder 160 and the suction valve 180 through the suction muffler 230, which is caused by suction valve closure.

In this case, the refrigerant gas flowing into the suction muffler 230 after ejected from the evaporator meets the refrigerant gas flowing backward into the suction muffler 230 from the suction valve 180.

Accordingly, the flowing pressure of the refrigerant gas flown backward into the suction muffler 230 obstructs the new refrigerant gas ejected from the evaporator from feeding into the cylinder 160 thereby causing a problem that the cooling power of the compressor is degraded by a large amount.

Further, when the refrigerant gas ejected from the evaporator passes through the suction valve 180 via the suction muffler 230, a complex sound pressure (noise) including vibrational noise and valve sonance produced from the suction valve and flowing noise of refrigerant gas is transferred to the refrigerant outlet 232 of the suction muffler 230 along the suction path of the refrigerant gas, i.e. a path along which the refrigerant gas is sucked to the suction portion 161 of the cylinder 160 through the suction muffler 230 and the suction valve 180.

In this case, the complex sound pressure transferred as above is not completely attenuated in the suction muffler

230. Accordingly, there is a problem that noise in the suction muffler 230 and the compressor is intensified. Further, the noise created in the compressor itself is transferred to the outside incurring noise pollution. In particular, there is a severe problem that the noise from the compressor may cause the compressor itself to break down.

SUMMARY OF THE INVENTION

Accordingly, the present invention has been made to solve the foregoing problems and it is an object of the present invention to provide a muffler in a reciprocating compressor which can reduce various noises produced from the flow of refrigerant and enhance the cooling ability as well as mount a floating valve within the muffler to reduce the reflow and enhance the attenuation effect of sound pressure.

The muffler of the invention is characterized in that the floating valve diverges and converges the reflowing refrigerant so that the refrigerant is converged again at a certain point after divergence to create a vortex flow thereby prevent any flow toward an inlet.

The muffler of the invention is further characterized in that the diverging and converging lengths of the floating valve is so adjusted that propagating sound pressures which diverge and converge in the floating valve have the mutual phase difference of 180° to offset each other thereby preventing further propagation of sound waves.

It is another object of the invention to provide a muffler in a reciprocating compressor, which has a Tesla valve having two distribution paths mounted within the muffler installed over a suction valve in order to attenuate a complex sound pressure (noise) such as vibrational noise, valve sonance and flowing noise and pulsative noise of refrigerant gas in low temperature discharged via an evaporator while enhance the cooling ability of the compressor by preventing the fluctuation of the refrigerant gas reflowing into the suction muffler so that the Tesla valve prevents the fluctuation of the refrigerant gas reflowing into the suction muffler from the suction valve thereby enhancing the cooling force of the compressor.

The muffler of the invention is characterized in that the Tesla valve enhances the attenuation effect of the complex sound pressure (noise) which is transferred to the suction valve through a suction path of the refrigerant gas leading to the suction muffler, the suction valve and the suction portion of the cylinder.

It is other object of the invention to provide a suction muffler in a reciprocating compressor, which mounts a Tesla valve having the two distribution paths within the suction muffler installed over a suction valve in order to attenuate the complex sound pressure (noise) such as vibrational noise, valve sonance and flowing noise and pulsative noise produced from the suction valve as well as enhance the cooling ability of the compressor.

According to an aspect of the invention to obtain the above objects, it is provided a muffler mounted for exhausting introduced refrigerant via a suction valve, attenuating the complex noise produced from the suction valve and enhancing the cooling ability in a reciprocating compressor, the muffler comprising: a floating valve for diverging the refrigerant flowing backward into the muffler from the suction valve at the first point and allowing diverged branches of the refrigerant to meet each other at the second point to attenuate the fluctuation of the refrigerant.

Preferably, the floating valve is a Tesla valve, and the Tesla valve includes two pipes for divergence and convergence.

More preferably, the pipes of divergence and convergence include linear and circular pipes, wherein one end of at least one pipe is coupled with a central portion of the other pipe.

Preferably, each of the linear and circular pipes is shaped as a venturi tube.

Preferably, a sound pressure transferred to the first pipe is diverged into the first and second sound waves at the first point to propagate along the first and second pipes, and the second sound wave propagating along the second pipe is offset at the second point where the first and second sound waves meet each other.

Further preferably, the first sound wave propagating along the first pipe and the second sound wave propagating along the second pipe have a phase difference of 180° at the second point.

According to another aspect of the invention to obtain the above objects, it is provided a muffler mounted in a reciprocating compressor for exhausting introduced refrigerant via a suction valve, reducing noise due to the fluctuation of the refrigerant and enhancing the cooling ability, the muffler comprising a Tesla valve having a plurality of pipes with two distribution paths to diverge and converge the refrigerant reflowing from the suction valve into the muffler.

Preferably, the Tesla valve includes a linear pipe and a circular pipe with one pipe penetrating a central portion of the other pipe to define divergence and convergence points of the reflowing refrigerant.

According to further another aspect of the invention to obtain the above objects, it is provided a muffler in a reciprocating compressor, comprising: a Tesla valve mounted to the muffler and having the first pipe with a small value of path resistance against the reflow of refrigerant and the second pipe with a relatively large value of path resistance, wherein the first and second pipes penetrate each other, whereby the refrigerant is discharged via a suction valve in respect to the stationary flow thereof, and diverged or converged in respect to the reflow thereof.

According to still another aspect of the invention to obtain the above objects, it is provided a muffler in a reciprocating compressor, comprising: a Tesla valve mounted to the refrigerant exit side and having the first and second pipes, wherein the first and second pipes have divergence and convergence points in respect to the reflow of refrigerant, and converge with the phase difference of 180° between the first sound pressure diverged to the first pipe and the second sound pressure diverged to the second pipe in respect to the reflow of refrigerant.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Figure 3:
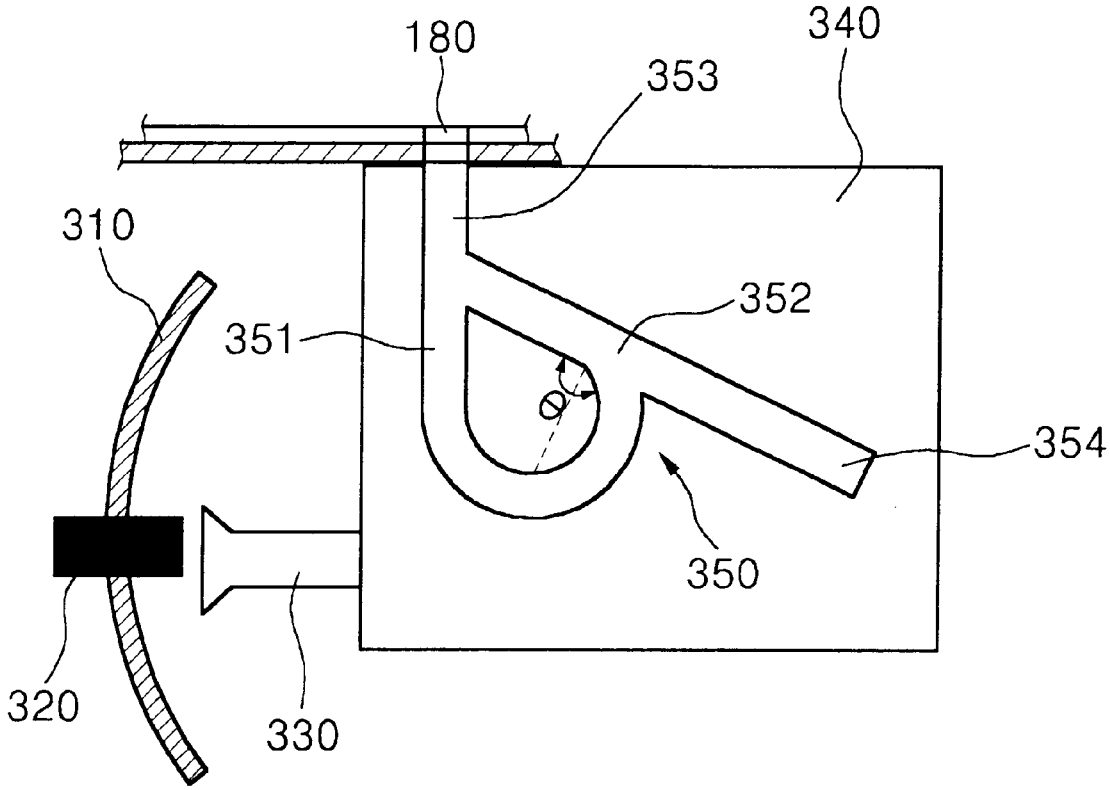
FIG. 3 is a detailed projective view illustrating a suction muffler mounted with a Tesla valve of the invention.
Figure 4:
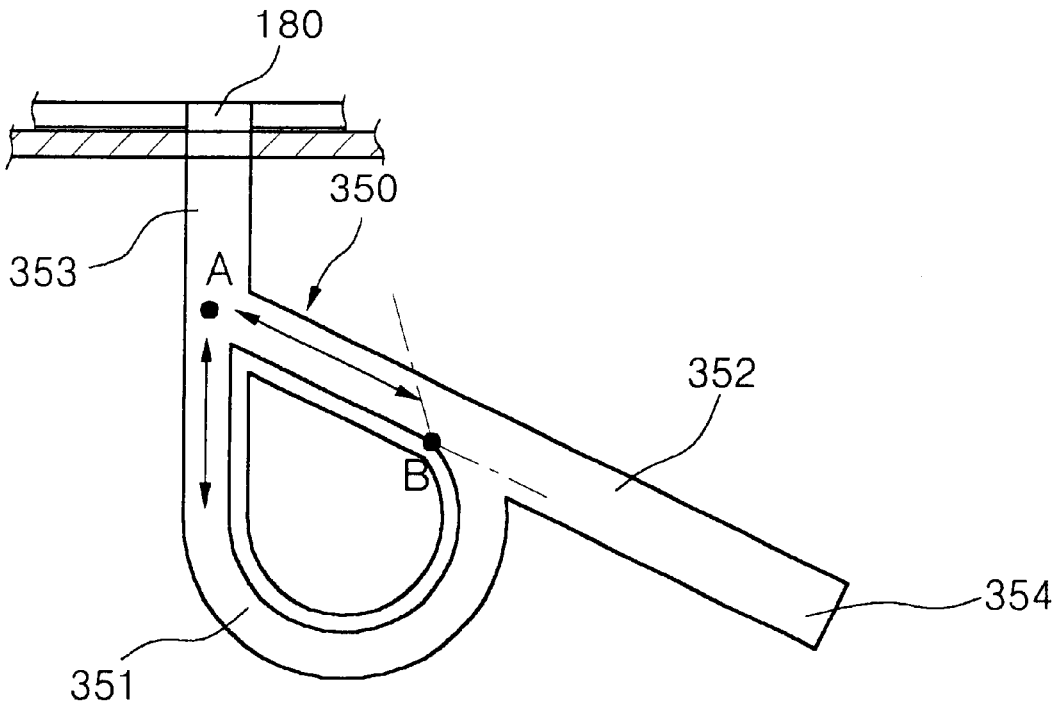
FIG. 4 is a sectional view illustrating a Tesla valve mounted within a suction muffler according to a preferred embodiment of the invention.

FIG. 3 is a detailed projective view illustrating a suction muffler mounted with a Tesla valve of the invention, and FIG. 4 is a sectional view illustrating the Tesla valve mounted within a suction muffler of the invention.

Referring to FIGS. 3 and 4, the invention is constituted of a suction muffler 340 installed over a suction valve 180 for reducing complex noise including vibrational noise, valve sonance and flowing noise and pulsative noise of refrigerant gas produced from the suction valve 180 when the refrigerant gas in low temperature and pressure is sucked into the cylinder 160 via the suction valve 180 and the cylinder suction portion 161 after ejected from an evaporator (not shown); and a Tesla valve 350 having two distribution paths 351 and 352 within the suction muffler 340 in order to prevent the refrigerant gas from flowing backward into the suction muffler 340 from the suction valve 180 as well as attenuate a complex sound pressure transferred from the suction valve 180.

The Tesla valve 350 is a type of a floating valve.

Figure 1:
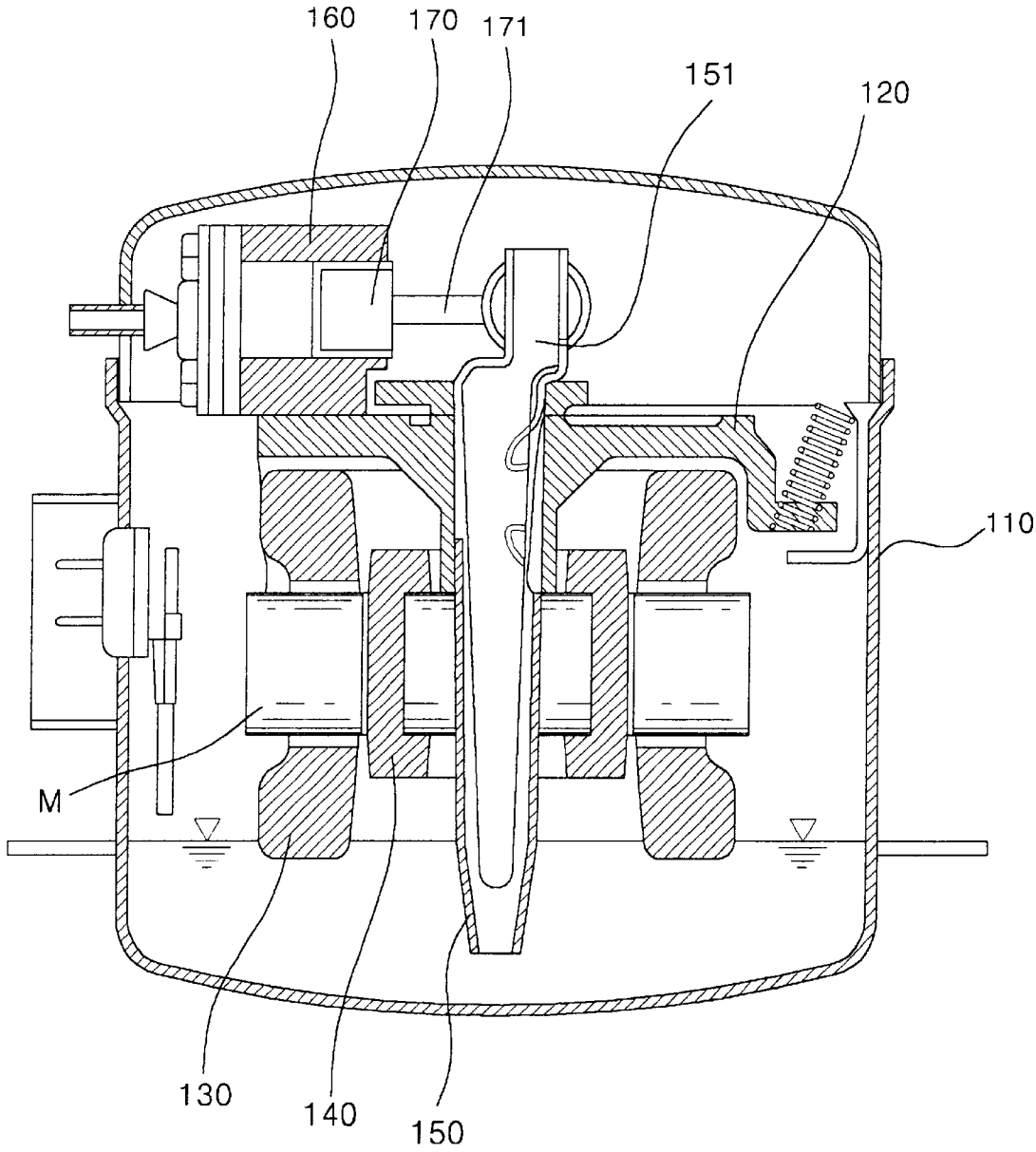
FIG. 1 (BACKGROUND ART)
FIG. 1 is the schematic construction of a reciprocating compressor.
Figure 2:
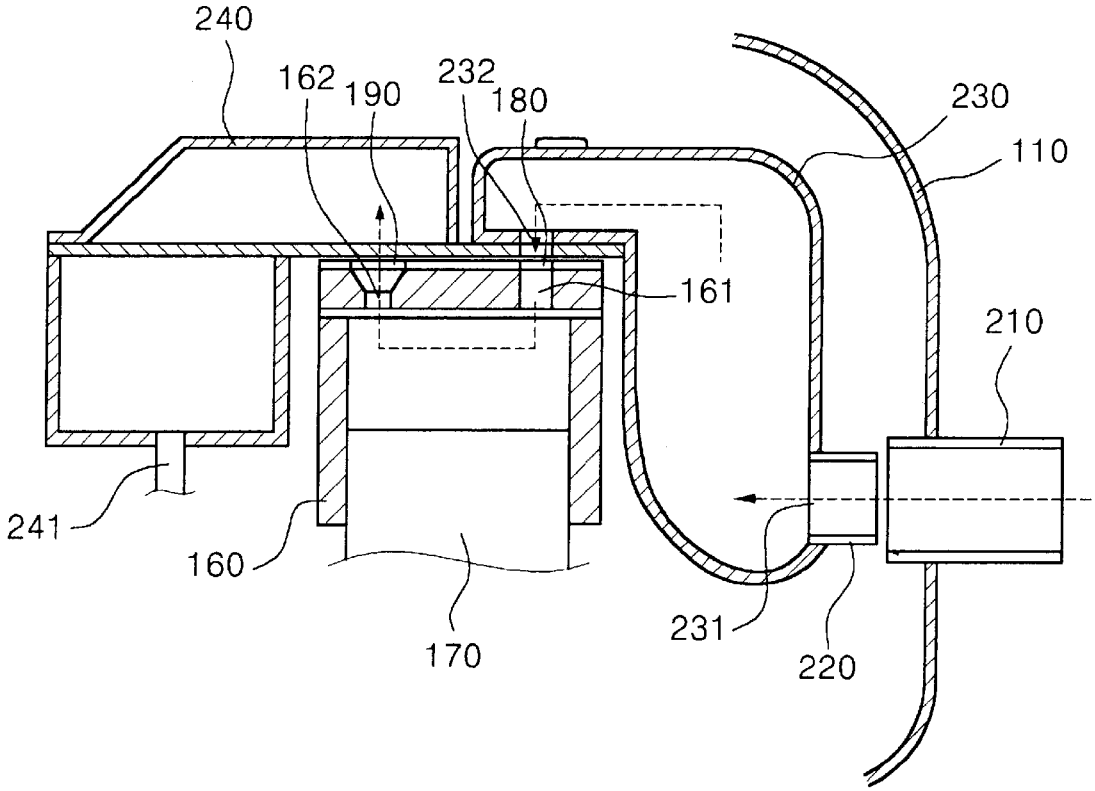
FIG. 2 (BACKGROUND ART)
FIG. 2 is a sectional view illustrating a suction structure of refrigerant gas in a conventional hermetic reciprocating compressor.

The following description will present the suction muffler in a reciprocating compressor of the invention, in which some of the components in FIG. 2 will be referred to for the convenience's sake of description.

Referring to FIGS. 3 and 4, the suction muffler 340 is a valve noise-blocking apparatus installed over the suction valve 180 for reducing and diminishing the complex noise including vibrational noise, valve sonance and flowing noise and pulsative noise of refrigerant gas produced from the suction valve 180 when the refrigerant gas in low temperature and pressure ejected from an evaporator (not shown) is sucked into the cylinder 160 via the suction valve 180 and the suction portion 161 of the cylinder 160.

Further, as shown in FIG. 3, the Tesla valve 350 having the two distribution paths within the suction muffler attenuates the reflow of the refrigerant gas into the suction muffler 340 from the suction valve 180 during flowing along a suction path of the refrigerant gas as well as the noise creation due to the complex sound pressure (noise) transferred from the suction valve 180.

Herein, the Tesla valve 350 has a curved pipe and a liner pipe which coupled with a venturi tube in the same configuration. When the lower end of the curved pipe couples with a central portion of the liner pipe, the two pipes are coupled to have an internal angle θ larger than 90°.

The Tesla valve 350, as shown in FIG. 4, is constituted of the circular pipe 351 and the linear pipe 352 for the two distribution paths, in which the circular pipe 351 communicates with the linear pipe 352 to define a configuration such as the venturi tube.

The Tesla valve 350 provides a divergence path or a convergence path by respectively penetrating one ends of the two pipes into central portions of the other pipes for the purpose of divergence at the first point and convergence at the second point about the refrigerant in reflow.

The refrigerant gas which was flowing along the suction path of the refrigerant gas leading to the suction portion 161 of the cylinder and the suction valve 180 through the suction muffler 340 flows backward into the refrigerant outlet 353 of the suction muffler 340. The complex sound pressure (noise) of the valve produced from the refrigerant gas passing through the suction valve 180 is transferred to the refrigerant outlet 353 of the suction muffler 340.

In this case, the refrigerant gas flown backward to the refrigerant outlet 353 of the suction muffler 340 from the suction valve 180 is diverged into two branches at a reflow divergence point A to flow through the pipes 351 and 352 after flowing within the Tesla valve 350. At a convergence point B, the diverged branches of refrigerant gas are mixed. At the same time, the refrigerant gas produces a vortex flow at the reflow convergence point B of the valve to block the flow of the refrigerant gas so that the refrigerant gas may not flow backward toward the refrigerant inlet 354 of the suction muffler 340 any longer.

Further, the complex sound pressure produced from the suction valve 180, after transferred to the refrigerant outlet 353 of the suction muffler 340, is diverged at the reflow divergence point A of the valve 350 to flow through the pipes 351 and 352. Then, the diverged complex sound pressure is synthesized at the reflow convergence point B.

At the same time, the circular pipe 351 and the linear pipe 352 are constructed to have the phase difference between two branches of the complex sound pressure of 180° in the vicinity of the reflow convergence point B of the valve 350 so that the two branches of the complex sound pressure are mutually offset and the complex sound pressure is not transferred any longer thereby attenuating the sound pressure.

Hereinafter it will be more specifically described about the operation of the Tesla valve which is mounted in the suction muffler to prevent the reflow of the refrigerant gas to the Tesla valve or attenuates the complex sound pressure of the suction valve transferred to the Tesla valve.

Figure 5:
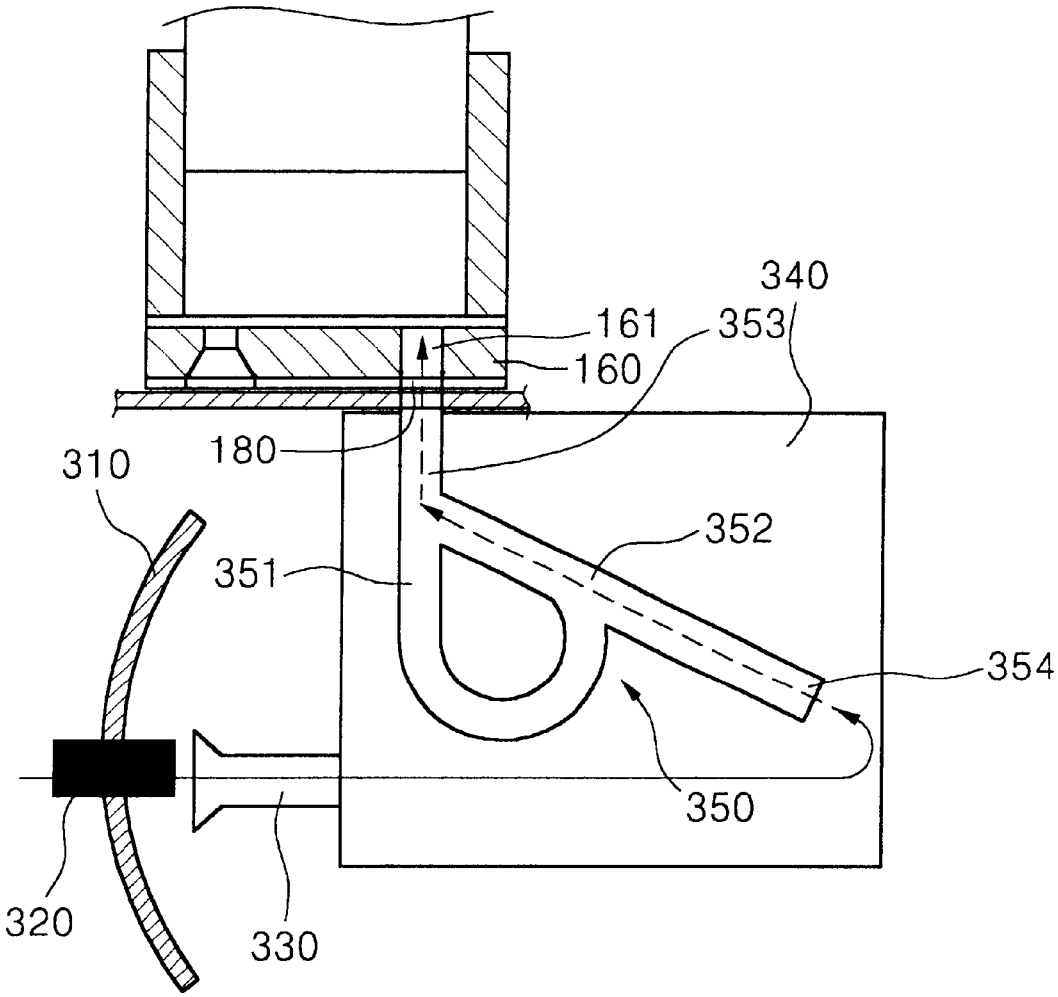
FIG. 5 illustrates the stationary flow of refrigerant gas in a suction muffler in a reciprocating compressor of the invention.
Figure 6:
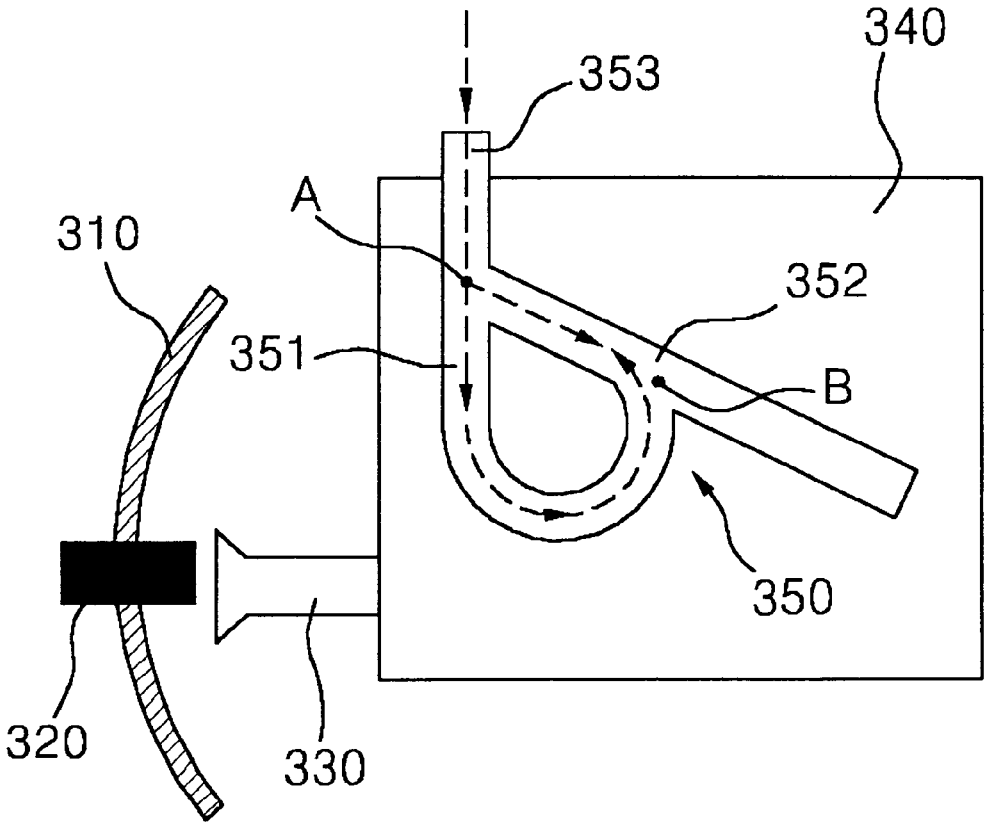
FIG. 6 illustrates the reflow of refrigerant gas in a suction muffler in a reciprocating compressor of the invention.
Figure 7:
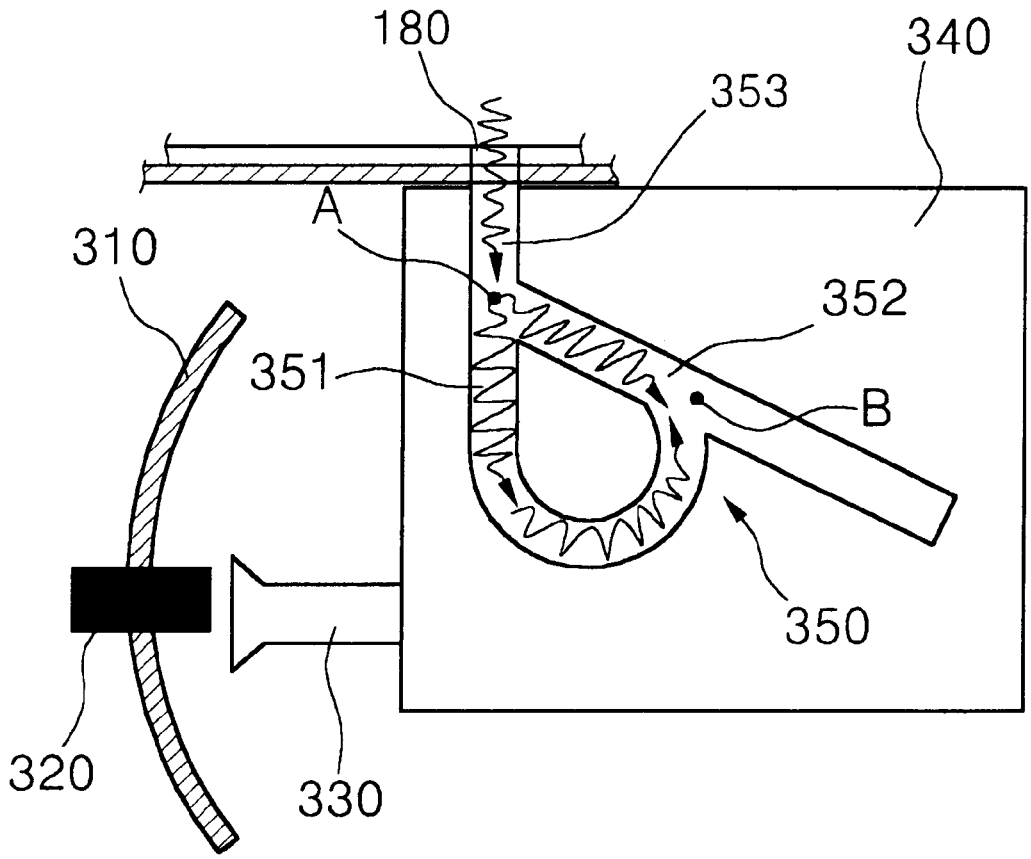
FIG. 7 illustrates the attenuation effect of sound pressure in a suction muffler in a reciprocating compressor of the invention.

FIGS. 5 to 7 illustrate the operation of the Tesla valve mounted in the suction muffler of the invention, in which FIG. 5 illustrates the stationary flow of the refrigerant gas, FIG. 5 illustrates the reflow of the refrigerant gas, and FIG. 5 illustrates the attenuation effect of sound pressure.

Referring to FIG. 5, the refrigerant gas in low temperature and pressure flowing out of the evaporator runs along the suction pipe 320 which is installed in a compressor shell (hermetic vessel) 310 in a penetrating manner, and then into the suction muffler 340 with a predetermined volume via a refrigerant suction portion 330 provided at one side of the suction muffler 340.

The refrigerant gas flown into the suction muffler 340 runs through the linear pipe 352 of the Tesla valve 350 mounted within the suction muffler 340 to flow into the circular pipe 351 communicating with the linear pipe 352, and then flows to the suction valve 180 via the refrigerant outlet 353 of the suction muffler 340. The refrigerant gas discharged as above is sucked into the cylinder 160 via the suction valve 180 and the suction portion 161 of the cylinder 160 through normal flow.

However, if the refrigerant gas flows backward into the suction muffler 340 after normally running through the suction path of the refrigerant gas which leads to the suction valve 180 and the suction portion of the cylinder 160 via the suction muffler 340 mounted with the Tesla valve 350 as shown in FIG. 5, the refrigerant gas flows into the Tesla valve 350 via the refrigerant outlet 353 of the suction muffler 340, and after running within the Tesla valve 350, diverges at the reflow divergence point A of the circular pipe 351 and the linear pipe 352 to flow into the circular pipe 351 and the linear pipe 352, respectively, as shown in FIG. 6.

At the reflow convergence point B, the refrigerant gas branches diverged from each other are mixed again. At the same time, due to the vortex flow of the diverged refrigerant flow near the reflow convergence point B of the valve 350, the refrigerant gas no more flows backward toward the refrigerant inlet 354 of the suction muffler 340. Like this, the Tesla valve 350 mounted within the suction muffler 340 prevents the reflow of the refrigerant gas.

Further, as shown in FIG. 7, the refrigerant gas discharged via the refrigerant outlet 353 of the suction muffler 340 produces the complex sound pressure (noise) such as vibrational noise, valve sonance and flowing noise and pulsative noise of refrigerant gas while passing through the suction valve 180, and this complex sound pressure is transferred to the refrigerant outlet 353 of the suction muffler 340. The transferred complex sound pressure is transferred into the Tesla valve 350 via the refrigerant outlet 353 of the suction muffler 340, and after propagating within the Tesla valve 350, diverged into two branches at the reflow divergence point A of the circular pipe 351 and the linear pipe 352 to respectively propagate along the circular pipe 351 and the linear pipe 352. Then, the two branches of the diverged complex sound pressure converge again at the reflow convergence point B of the circular pipe 351 and the linear pipe 352.

At the same time, the two branches of the complex sound pressure are offset due to the phase difference between the two branches of the complex sound pressure diverged near the reflow convergence point B, i.e. the phase difference of 180° between the circular pipe 351 and the linear pipe 352 so that the complex sound pressure is not further transferred. In this manner, the complex sound pressure is attenuated by the Tesla valve 350 mounted within the suction muffler 340.

Figure 8:
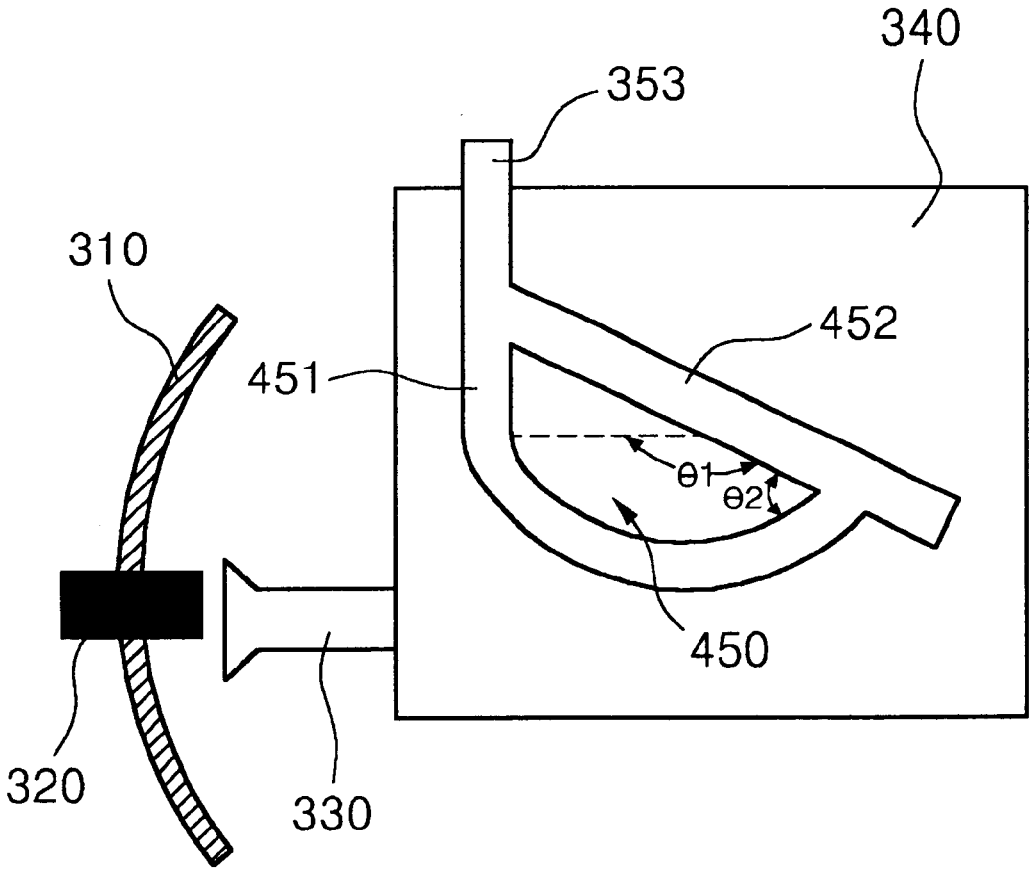
FIGS. 8 and 9 are sectional views illustrating the structures of Tesla valves according to alternative embodiments of the invention.

In FIG. 8, a Tesla valve 450 can have a linear pipe 452, a circular pipe 451, in which linear pipe 452 is positioned at an angle $\theta 1$ with respect to the direction in refrigerant outlet 353, and the lower end of the circular pipe 451 is coupled at angle $\theta 2$ to the linear pipe 452.

Figure 9:
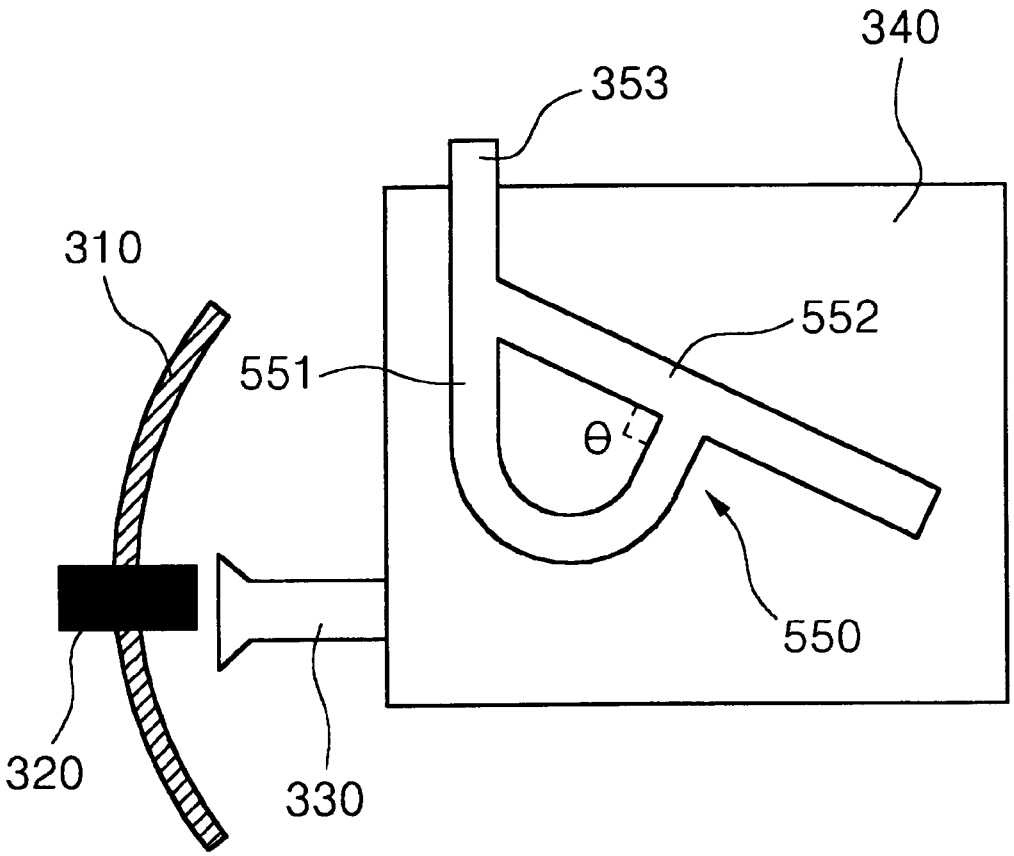

Further, in FIG. 9, a Tesla valve 550 can have a linear pipe 552 and a circular pipe 551, in which the central portion of the linear pipe 552 and the lower end of the circular pipe 551 are coupled with an internal angle $\theta$ of 90° at a convergence point.

In the Tesla valve as set forth above, the two pipes can be so coupled that the internal angle can be freely varied at the convergence point where the central portion of the linear pipe couple with the one end of the circular pipe.

The suction muffler in the reciprocating compressor of the invention attenuates the complex sound pressure (noise) such as vibrational noise, valve sonance and flowing noise and pulsative noise of refrigerant gas produced from the suction valve when the refrigerant gas in low temperature and pressure discharged via the evaporator is sucked into the cylinder suction portion via the suction valve after passing through the suction muffler.

Moreover, in order to enhance the cooling ability of the compressor by preventing the fluctuation of the refrigerant gas flowing backward into the suction muffler, the Tesla valve having the two distribution paths is mounted within the suction muffler installed over the suction valve. So, the Tesla valve prevents the fluctuation of the refrigerant gas which flows backward into the suction muffler from the suction valve, thereby having a remarkable effect of improving the cooling ability of the compressor.

Further, there is an excellent effect that the Tesla valve mounted within the suction muffler can attenuate the complex sound pressure (noise) which is transferred from the suction valve through the suction path of the refrigerant gas leading to the suction muffler, the suction valve and the suction portion of the cylinder.

What is claimed is:

1. A suction muffler located between a suction valve and a suction inlet of a compressor, the suction muffler attenuating complex noise produced from the suction valve and enhancing the cooling ability in the compressor, the suction muffler comprising:

a floating valve having a refrigerant inlet adjacent to the suction inlet and a refrigerant outlet connected to the suction valve, wherein at a first point between the refrigerant inlet and the refrigerant outlet of the floating valve the refrigerant flowing backward from the suction valve diverges, and wherein at a second point between the refrigerant inlet and the refrigerant outlet of the floating valve, the diverged refrigerant converges in order to attenuate the fluctuation of the refrigerant.

2. The suction muffler according to claim 1, wherein the floating valve is a Tesla valve.

3. The suction muffler according to claim 2, wherein the Tesla valve includes two pipes for divergence and convergence.

4. The suction muffler according to claim 3, wherein the pipes for divergence and convergence include linear and circular pipes, wherein one end of at least one pipe is coupled with a central portion of the other pipe.

5. The suction muffler according to claim 4, wherein each of the linear and the circular pipes is shaped as a venturi tube.

6. The suction muffler according to claim 4, wherein the linear pipe and the circular pipe penetrate each other to have two distribution paths.

7. The suction muffler according to claim 4, wherein a central portion of the linear pipe of the Tesla valve is coupled with one end of the circular pipe at a convergence point in respect to reflowing refrigerant with an internal angle larger than 90°.

8. The suction muffler according to claim 4, wherein a central portion of the linear pipe of the Tesla valve is coupled with one end of the circular pipe at a convergence point in respect to reflowing refrigerant with an internal angle smaller than 90°.

9. The suction muffler according to claim 4, wherein a central portion of the linear pipe of the Tesla valve is coupled with one end of the circular pipe at a convergence point in respect to reflowing refrigerant with an internal angle of 90°.

10. The suction muffler according to claim 1, wherein the suction muffler has a cavity, and the floating valve is mounted to a refrigerant exit side.

11. The suction muffler according to claim 1, wherein a sound pressure transferred to a first pipe is diverged into a first sound wave and a second sound wave at the first point to propagate along the first pipe and a second pipe, the second sound wave propagating along the second pipe being offset at the second point where the first sound wave and the second sound wave meet each other.

12. The suction muffler according to claim 11, wherein the first sound wave propagating along the first pipe and the second sound wave propagating along the second pipe have a phase difference of 180° at the second point.

13. The suction muffler according to claim 1, wherein the compressor is a reciprocating compressor.

14. A suction muffler located between a suction valve and a suction inlet of a compressor, the suction muffler reducing noise due to the fluctuation of the refrigerant and enhancing the cooling ability, the suction muffler comprising:

a Tesla valve having at least two pipes with two distribution paths to diverge and converge the refrigerant reflowing from the suction valve into the suction muffler, wherein the pipes have their own lengths which are respectively selected to have a phase difference of 180° between two sound pressures propagating due to the fluctuation of the refrigerant passing through the two pipes according to the divergence of the reflowing refrigerant.

15. The suction muffler according to claim 14, wherein the at least two pipes of the Tesla valve include a linear pipe and a circular pipe with one pipe penetrating a central portion of the other pipe to define divergence and convergence points of the reflowing refrigerant.

16. A suction muffler located between a suction valve and a suction inlet of a compressor, the suction muffler, comprising:

a Tesla valve mounted to the suction muffler and having a first pipe with a small value of path resistance against the reflow of refrigerant and a second pipe with a relatively large value of path resistance, wherein the first pipe and the second pipe penetrate each other, whereby the refrigerant is discharged via a suction valve in respect to a stationary flow thereof, and diverged or converged in respect to a reflow thereof.

17. The suction muffler according to claim 16, wherein the first pipe is the linear pipe, and the second pipe is the circular pipe, the first and the second pipe being coupled into the shape of a venturi tube to have at least one divergence and convergence point.

18. The suction muffler according to claim 17, wherein the circular pipe has one end mounted to the suction valve and the other end connected to the linear pipe by penetrating a central portion thereof.

19. The suction muffler according to claim 17, wherein the linear pipe and the circular pipe penetrate each other to define a shape of a venturi tube.

20. A suction muffler located between a suction valve and a suction inlet of a compressor, the suction muffler comprising:

a Tesla valve mounted to a refrigerant exit side and having a first and a second pipe, wherein the first and the second pipes have divergence and convergence points in respect to a reflow of refrigerant, and converge with a phase difference of 180° between a first sound pressure diverged to the first pipe and a second sound pressure diverged to the second pipe in respect to the reflow of refrigerant.

21. The suction muffler according to claim 20, wherein the first pipe is linear, the second pipe is circular, and the two pipes are shaped as a venturi tube.

22. A suction muffler mounted for exhausting introduced refrigerant via a suction valve, attenuating complex noise produced from the suction valve and enhancing the cooling ability in a reciprocating compressor, the suction muffler comprising:

a floating valve having a refrigerant inlet adjacent to the suction inlet and a refrigerant outlet connected to the suction valve, the floating valve for diverging the refrigerant flowing backward into the suction muffler from the suction valve at a first point, and allowing diverged branches of the refrigerant to meet each other at a second point between the first point and the refrigerant inlet in order to attenuate the fluctuation of the refrigerant, the floating valve including a first pipe and a second pipe for divergence and convergence, one of which is a linear pipe and another of which is a circular pipe, and at least one end of the circular pipe being coupled with a central portion of the linear pipe at a convergent point in respect to reflowing refrigerant with an internal angle of at least 90°.

23. A compressor comprising:

a suction muffler disposed in a sealed vessel of the compressor and located between a suction valve and a suction inlet of the compressor, the suction muffler attenuating complex noise produced from the suction valve and enhancing the cooling ability in the compressor, the suction muffler including:

a floating valve having a refrigerant inlet adjacent to the suction inlet and a refrigerant outlet connected to the suction valve, wherein at a first point between the refrigerant inlet and the refrigerant outlet of the floating valve the refrigerant flowing backward from the suction valve diverges, and wherein at a second point between the refrigerant inlet and the refrigerant outlet of the floating valve, the diverged refrigerant converges in order to attenuate the fluctuation of the refrigerant.

24. The compressor according to claim 23, the floating valve including a first pipe and a second pipe for divergence and convergence, one of which is a linear pipe and another of which is a circular pipe, and at least one end of the circular pipe being coupled with a central portion of the linear pipe at a convergent point in respect to reflowing refrigerant with an internal angle larger than 90°.

25. The compressor according to claim 23, the floating valve including a first pipe and a second pipe for divergence and convergence, one of which is a linear pipe and another of which is a circular pipe, and at least one end of the circular pipe being coupled with a central portion of the linear pipe at a convergent point in respect to reflowing refrigerant with an internal angle smaller than 90°.

26. The compressor according to claim 23, the floating valve including a first pipe and a second pipe for divergence and convergence, one of which is a linear pipe and another of which is a circular pipe, and at least one end of the circular pipe being coupled with a central portion of the linear pipe at a convergent point in respect to reflowing refrigerant with an internal angle of 90°.

27. A suction muffler located between a suction valve and a suction inlet of a compressor, the suction muffler attenuating complex noise produced from the suction valve and enhancing the cooling ability in the compressor, the suction muffler comprising:

a floating valve for diverging the refrigerant flowing backward into the suction muffler from the suction valve at a first point and allowing diverged branches of the refrigerant to meet each other at a second point to attenuate the fluctuation of the refrigerant, wherein a sound pressure transferred to a first pipe is diverged into a first sound wave and a second sound wave at the first point to propagate along the first pipe and a second pipe, the second sound wave propagating along the second pipe being offset at the second point where the first sound wave and the second sound wave meet each other.

28. The suction muffler according to claim 27, wherein the first sound wave propagating along the first pipe and the second sound wave propagating along the second pipe have a phase difference of 180° at the second point.

* * * * *